United States Patent [19]

Wang et al.

[11] 4,186,083

[45] Jan. 29, 1980

[54] PROCESS FOR FROTH FLOTATION OF NON-SULFIDE MINERALS

[75] Inventors: Samuel S. Wang, Cheshire; Eugene L. Smith, Jr.; Ernie F. Huliganga, both of Milford, all of Conn.

[73] Assignee: American Cyanamid Company, Stamford, Conn.

[21] Appl. No.: 863,034

[22] Filed: Dec. 21, 1977

[51] Int. Cl.[2] ..... B03D 1/02

[52] U.S. Cl. ..... 209/166

[58] Field of Search ..... 209/166, 167; 252/66

[56] References Cited

U.S. PATENT DOCUMENTS

| | | | |
|---|---|---|---|
| 2,182,845 | 12/1939 | Harris | 209/166 |
| 2,414,815 | 1/1947 | Kennedy | 209/166 |
| 2,442,455 | 6/1948 | Booth | 209/166 |
| 2,764,602 | 9/1956 | Ahlbrecht | 209/163 X |
| 2,879,302 | 3/1959 | England | 209/166 X |
| 3,186,546 | 6/1965 | Keen | 209/166 |
| 4,136,019 | 1/1979 | Wilson | 209/166 |

FOREIGN PATENT DOCUMENTS

| | | | |
|---|---|---|---|
| 105712 | 5/1938 | Australia | 209/166 |
| 2338324 | 12/1977 | France | 209/166 |
| 165140 | 9/1963 | U.S.S.R. | 210/44 |

OTHER PUBLICATIONS

Chem. Abstracts, vol. 80, 1974, 49584j.

*Primary Examiner*—Robert Halper
*Attorney, Agent, or Firm*—William J. Van Loo

[57] ABSTRACT

An improved process of froth flotation for non-sulfide minerals arises when the collector employed is a combination of a fatty acid and an anionic per fluorosulfonate compound.

5 Claims, No Drawings

PROCESS FOR FROTH FLOTATION OF NON-SULFIDE MINERALS

CROSS-REFERENCE TO RELATED APPLICATIONS

This application is related to application Ser. No. 863,035 filed on Dec. 21, 1977, now U.S. Pat. No. 4,147,644. This application relates to a process of beneficiating non-sulfide mineral by froth flotation using a combination collector and the related application relates to the composition of the collector combination.

This invention relates to an improved process for beneficiating non-sulfide minerals. More particularly, this invention relates to such a process wherein a combination of a fatty acid and an anionic perfluorosulfonate compound is used as the collector for non-sulfide minerals in froth flotation.

Froth flotation is the principal means by which phosphate, barite, fluorite, hematite, taconite, magnetite and a host of other ores are concentrated. Its chief advantage lies in the fact that it is a relatively efficient process operating at substantially lower costs than many other processes.

Flotation is a process for separating finely ground valuable minerals from their associated gangue, or waste, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation depends upon the relative wettability of surfaces. Typically, the surface free energy is purportedly lowered by the adsorption of heteropolar surface active agents. The hydrophobic coating thus provided in this explanation acts as a bridge so that the particle may be attached to an air bubble. It is to be understood, however, that the practice of this invention is not limited by this or other theories.

Phosphate rock is a typical example of a non-sulfide mineral. Typically, phosphate ore containing about 15–35% BPL[bone phosphate of lime, $Ca_3(PO_4)_2$] is concentrated in very large tonnages from the Florida pebble phosphate deposits. The ore slurry from strip mining is sized at about 1 millimeter and the coarser fraction, after scrubbing to break up mud balls, is a finished product. The minus 1 mm fraction is further sized at 35 and 200 mesh. The minus 200 mesh slime is discarded. From the sizing operation, the +35 mesh fraction in thick slurry is treated with fatty acid, fuel oil and caustic, ammonia, or other alkaline material and the resulting agglomerates are separated on shaking tables, spirals or spray belts. The 35×200 mesh fraction is conditioned with the same type of reagents and floated by conventional froth flotation routes. Not all the silica gangue is rejected by the fatty acid flotation, so the concentrate is blunged with acid to remove collector coatings, deslimed, washed free of reagents and subjected to an amine flotation with fuel oil at pH 7–8. This latter flotation, sometimes called "cleaning" removes additional silica and raises the final concentrate grade to 75–80% BPL.

Although the procedure described above is effective in the recovery of mineral values of non-sulfide ores, there, nevertheless, exists the need for more effective processes which provide increased recovery of non-sulfide minerals while still providing high grade. It is particularly desirable to reduce the requirements for fatty acids which are constantly being diverted to nutritional and other uses. In view of the high quantities of non-sulfide minerals processed by froth flotation, such a development can result in a substantial increase in the total amount of mineral values recovered and provide substantial economic advantages even when a modest increase in recovery is provided. It is also highly desirable to have an efficient process which reduces dosage requirements of collector without sacrificing the mineral recovery performance. The decreases in reagent consumption are significant in view of the increasing diversion of fatty acids to nutritional and other uses. Accordingly, the provision for an improved process for beneficiating non-sulfide minerals by froth flotation would fulfill a long-felt need and constitute a notable advance in the art.

In accordance with the present invention, there is provided a process for beneficiating non-sulfide minerals which comprises classifying the ore to provide particles of flotation size, slurrying the sized ore in aqueous medium, conditioning the slurry with an effective amount of a collector combination and floating the desired mineral values by froth flotation, said collector combinaton comprising from about 70 to about 99.9 weight percent of a fatty acid derived from a vegetable or animal oil and, correspondingly, from about 30 to about 0.1 weight percent of an anionic perfluoro compound of the general formula $$CF_3\text{-}(CF_2)_m(CH_2)_nY\text{—}X$$

wherein Y is $—COO^-$ or $—SO_3^-$, X is a hydrogen, alkali metal or ammonium ion, m is an integer of from about 4 to 8, and n is 0 or 1.

The process of the present invention provides higher recovery than is obtained by conventional processes. The process reduces requirements for fatty acid while providing higher recovery at high grade.

In carrying out the process of the present invention, a non-sulfide mineral is selected for treatment. Suitable non-sulfide ores include phosphate, hematite, barite, fluorite, calcite, magnesite, sheelite and other non-sulfide ores that are froth floated using an acid collector. The selected mineral is screened to provide particles of flotation size according to conventional procedures. Generally, the flotation size will encompass from about 35×200 mesh particles.

After the selected mineral has been sized as indicated, it is slurried in aqueous medium and conditioned with an effective amount of a collector combination comprising a fatty acid derived from a vegetable or animal oil and an anionic perfluoroalkyl compound. Generally, an effective amount will be in the range of about 0.1 to 2.0 pounds per ton of ore but variations outside this range may occur depending upon the specific non-sulfide ore processed, the nature and amount of gangue material present, the particular collector combination employed, the actual values of recovery and grade desired and the like.

The collector combination will comprise from about 70 to about 99.9 weight percent of a fatty acid derived from a vegetable or mineral oil and, correspondingly, from about 30 to about 0.1 weight percent of an anionic perfluoro compound of the general formula $$CF_3\text{-}(CF_2)_m(CH_2)_nY\text{—}X$$

wherein Y is $—COO^-$ or $—SO_3^-$, X is a hydrogen, alkali metal or ammonium ion, m is an integer of about 4 to 8, and n is 0 or 1. In preferred instances, the fatty acid will comprise from about 90–99.9 weight percent and the anionic perfluoro compound from about 10 to 0.1 weight percent of the collector combination.

As indicated, the fatty acid is one derived from a vegetable or animal oil. Illustrative vegetable oils include babassu, castor, Chinese tallow, coconut, corn, cottonseed, grapeseed, hempseed, kapok, linseed, wild mustard, oiticica, olive, ouri-ouri, palm, palm kernel, peanut, perilla, poppyseed, Argentine rapeseed, rubberseed, safflower, seasame, soybean, sugarcane, sunflower, tall, teaseed, tung and ucuhuba oils. Animal oils include fish and livestock oils. These oils contain acids ranging from six to twenty-eight carbon atoms or more which may be saturated or unsaturated, hydroxylated or not, linear or cyclic and the like.

The anionic perfluoro compound has the general formula $$CF_3\text{-}(CF_2)_m(CH_2)_nY\text{—}X$$

wherein Y is $—COO^-$ or $—SO_3^-$, X is hydrogen, alkali metal or ammonium ion, m is an integer of from about 4 to 8, and n is 0 or 1. Preferred compounds of this type include $$CF_3\text{-}(CF_2)_6COONH_4$$

$$CF_3\text{-}(CF_2)_6SO_3K$$

as well as the corresponding free acids and sodium salts.

In addition to the collector combination, conditioning may also include other reagents as are conventionally employed in froth flotation. Non-sulfide minerals are generally processed at about 6.0 to 12.0, preferably about 8.0 to 10.0. Accordingly, pH regulators may be uses as well as frothers, fuel oil and the like.

After the slurry has been conditioned, it is subjected to froth flotation following conventional procedures. The desired mineral values are recovered with the froth and the gangue remains behind.

The invention is more fully illustrated in the examples which follow wherein all parts and percentages are by weight unless otherwise specified. Although the invention is exemplified with phosphate rock, a typical non-sulfide mineral, it is to be understood that similar benefits are obtained with all non-sulfide minerals that are froth floated using an acid collector. The following general procedure is employed in the froth flotation examples which follow.

GENERAL PROCEDURE

Rougher Float

Step 1: Secure washed and sized feed, e.g., 35×150 mesh screen fractions. Typical feed is usually a mixture of 23% coarse with 77% fine flotation particles.

Step 2: Sufficient wet sample, usually 640 grams, to give a dry weight equivalent of 500 grams. The sample is washed once with about an equal amount of tap water. The water is carefully decanted to avoid loss of solids.

Step 3: The moist sample is conditioned for one minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct endpoint. At the end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5: The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are dry weights of the concentrate and tailings, respectively, and $P_c$ and $P_t$ are the weight percent $P_2O_5$ or BPL of the concentrate or tails, respectively.

EXAMPLE 1

Following the general procedure, a series of collector combinations were employed in the froth flotation of Florida pebble phosphate. In separate runs, a fatty acid derived from tall oil was employed alone and in combination with each of two perfluoro compounds. In each instance, the total dosage of collector was 0.5 lbs. per ton and an equal dosage of No. 5 fuel oil was employed. The slurry was adjusted to pH 9.0 with caustic. The compounds employed and the results obtained are given in Table I which follows.

Table I

Froth Flotation of Florida Phosphate

| Run | Booster | Ratio Fatty Acid/Booster | Recovery Weight(%) | BPL % Feed | BPL % Tail | BPL % Conc | BPL Recovery(%) |
|---|---|---|---|---|---|---|---|
| 1 | None | — | 17.01 | 17.56 | 6.92 | 69.59 | 67.30 |
| 2 | $CF_3\text{-}(CF_2)_6\text{-}COONH_4$ | 99.5/0.5 | 21.17 | 18.06 | 4.87 | 67.19 | 78.75 |

Table I-continued

| Run | Booster | Froth Flotation of Florida Phosphate: Ratio Fatty Acid/Booster | Recovery Weight(%) | BPL % Feed | Tail | Conc | BPL Recovery(%) |
|---|---|---|---|---|---|---|---|
| 3 | $CF_3-(CF_2)_6-SO_3K$ | 99.5/0.5 | 19.25 | 18.63 | 6.49 | 69.55 | 71.87 |

EXAMPLE 2

Again, following the general procedure, a series of runs were made using a fatty acid derived from tall oil and the perfluoro compound $CF_3-(CF_2)_6COONH_4$ in various weight percent combinations as well as in separate uses. The compositions employed and the results obtained are given in Table II. To obtain the expected value for recovery listed in Table II, a plot of the results using fatty acid alone and perfluoroalkyl compound alone was made. A straight line connecting these two points was then constructed. The expected value for recovery is that value read from the plot which corresponds to the composition of the collector combination.

TABLE II

| Run | Collector Composition: F.A. % | PFA % | Recovery Weight % | BPL (%) Feed | Tail | Conc | BPL Recovery(%) | Expected Recovery(%) |
|---|---|---|---|---|---|---|---|---|
| 1 | 100 | 0 | 17.01 | 17.56 | 6.92 | 69.49 | 67.30 | 67.30 |
| 2 | 95 | 5 | 20.49 | 18.57 | 5.52 | 68.90 | 76.28 | 64.00 |
| 3 | 90 | 10 | 21.10 | 18.47 | 4.81 | 69.55 | 79.45 | 60.50 |
| 4 | 80 | 20 | 18.27 | 18.61 | 6.98 | 70.67 | 69.36 | 59.00 |
| 5 | 70 | 30 | 16.87 | 15.94 | 5.43 | 67.71 | 71.68 | 47.00 |
| 6 | 60 | 40 | 5.79 | 16.90 | 13.98 | 64.55 | 22.10 | 40.00 |
| 7 | 50 | 50 | 4.82 | 16.98 | 14.41 | 67.67 | 19.21 | 33.50 |
| 8 | 40 | 60 | 0.52 | 18.26 | 18.22 | 26.70 | 0.76 | 27.00 |
| 9 | 0 | 100 | 0.16 | Insufficient to Assay | | | | 0 |

Notes:
FA = Fatty acid derived from tall oil
PFA = $CF_3-(CF_2)_6-COONH_4$

The results show that collector combinations comprising at least 60 weight percent of fatty acid provide booster action over the use of fatty acid alone. Surprisingly, combinations containing more than about 40 weight percent of perfluoro compound depress action compared to fatty acid alone.

We claim:

1. A process for beneficiating non-sulfide minerals which comprises classifying the ore to provide particles of flotation size, slurrying the sized ore in aqueous medium, conditioning the slurry with an effective amount of a collector combination and floating the desired mineral values by froth flotation, said collector combination comprising from about 70 to about 99.9 weight percent of a fatty acid derived from a vegetable or animal oil and, correspondingly, from about 30 to about 0.1 weight percent of an anionic perfluorosulfonate compound of the general formula $$CF_3-(CF_2)_m(CH_2)_nY-X$$

wherein Y is $-SO_3^-$, X is hydrogen, alkali metal or ammonium ion, m is an integer of from about 4 to 8 and n is 0 or 1.

2. The process of claim 1 wherein m in said perfluoroalkyl compound has a value of 6.

3. The process of claim 2 wherein X in said perfluoroalkyl compound is potassium ion.

4. The process of claim 1 wherein said collector combination comprises from about 90 to 99.9 weight percent of fatty acid and from about 10 to 0.1 weight percent of perfluoroalkyl compound.

5. The process of claim 1 wherein said non-sulfide ore is phosphate rock.

* * * * *